US005718382A

United States Patent [19]

Jaeger

[11] Patent Number: 5,718,382

[45] Date of Patent: Feb. 17, 1998

[54] APPARATUS FOR CLEANING VESSELS

[76] Inventor: Ben E. Jaeger, 50 Hunter La., Plano, Ill. 60545

[21] Appl. No.: 718,606

[22] Filed: Sep. 23, 1996

Related U.S. Application Data

[63] Continuation of Ser. No. 327,975, Oct. 24, 1994, abandoned.

[51] Int. Cl.[6] ..... B05B 3/02

[52] U.S. Cl. ..... 239/227; 239/600

[58] Field of Search ..... 239/227, 225, 239/237, 240, 281, 600; 134/181, 24

[56] References Cited

U.S. PATENT DOCUMENTS

| | | | |
|---|---|---|---|
| 3,001,534 | 9/1961 | Grant | 239/227 X |
| 3,150,669 | 9/1964 | Green, Jr. . | |
| 3,444,869 | 5/1969 | Guignon et al. | 239/227 X |
| 3,532,273 | 10/1970 | Siddall et al. . | |
| 3,645,452 | 2/1972 | Stoeckel et al. | 239/227 |
| 3,874,594 | 4/1975 | Hatley . | |
| 3,878,857 | 4/1975 | Heibo . | |
| 3,895,756 | 7/1975 | Jaeger . | |
| 4,244,523 | 1/1981 | Looper . | |
| 4,351,478 | 9/1982 | Looper . | |
| 4,574,825 | 3/1986 | Haug . | |
| 4,690,159 | 9/1987 | Vadakin et al. . | |
| 4,716,917 | 1/1988 | Schmidt . | |
| 4,945,933 | 8/1990 | Krajicek et al. . | |
| 5,056,716 | 10/1991 | Robinson . | |
| 5,107,879 | 4/1992 | Harvey | 239/227 X |

FOREIGN PATENT DOCUMENTS

| | | | |
|---|---|---|---|
| 1251344 | 10/1971 | United Kingdom | 239/227 |

*Primary Examiner*—Kevin Weldon
*Attorney, Agent, or Firm*—Juettner Pyle Lloyd & Piontek

[57] ABSTRACT

An apparatus for cleaning vessels is inserted into a vessel to automatically clean the interior thereof. The apparatus is particularly adapted to clean rail tank cars and similar vessels, and includes a spray nozzle that is moved at a controlled speed back and forth across the length and width of deposits within the tank to blast loose and flush the deposits out of a drain from the tank. The spray nozzle is carried at a lower end of a support trunk, and is rotated back and forth about respective longitudinal and transverse axes to direct a jet stream of solvent against the deposits. The support trunk is pivotable to shift the spray nozzle from side to side within the vessel to clean behind obstructions often found in tanks, and vertically movable to position the spray nozzle at selected heights within the tank. The apparatus can be rotated about a vertical axis to rotate the longitudinal and transverse axes about which the spray nozzle is rotated.

27 Claims, 3 Drawing Sheets

APPARATUS FOR CLEANING VESSELS

This is a continuation of application Ser. No. 08/327,975 filed on Oct. 24, 1994 now abandoned.

BACKGROUND OF THE INVENTION

The present invention relates to apparatus for cleaning vessels such as railroad tank cars and the like, and in particular to an improved apparatus for cleaning the interiors of such vessels with a jet stream of solvent.

Cleaning enclosed tanks and other confined areas often proves to be a difficult, tedious and time consuming task. In the past, such cleaning operations were accomplished by manual labor, and often that is the case today. However, since tanks may contain chemicals or other materials that involve toxic or corrosive substances and vapors that may create a hazardous environment for the worker, it is desirable to clean such enclosures without need for direct manual intervention.

A typical situation is the cleaning or removal of sludge from truck or railway tank cars, which have an access opening or manway at the top. An individual can be lowered into the tank to scrape and loosen the sludge, but it is more desirable that the tank be cleaned with an apparatus specially adapted for the purpose, such as with an apparatus as described in U.S. Pat. No. 3,895,756, issued to Ben E. Jaeger, the present patentee, on Jul. 22, 1975. The tank cleaner of said patent uses a high pressure stream of solvent to automatically clean the interior of a tank. On command from a program control, a spray nozzle directs a concentrated jet stream of solvent in a preset pattern to cut, dissolve and flush deposits out of a bottom tank drain port. The high pressure stream typically is delivered at up to about 250 gallons per minute at pressures up to about 250 psi to remove sludge, debris or other bottom deposits and precipitates without disturbing the tank or its lining. Cleaning a tank begins by lowering the spray nozzle into the tank through the manway. Once in place, the nozzle is rotated back and forth about longitudinal and transverse axes to sweep across the length and width of the tank, to direct a high pressure stream of solvent against caked-on deposits of sludge-like material in the bottom of the tank. Blasted into slurry form, the sediment flows out through the bottom drain. Movement of the nozzle may be controlled so that, for example, the jet stream travels the length of the tank in about two minutes, with about fifteen minutes being required to cover the tank from side to side. Operation is fully automatic, and the nozzle position is displayed on a control and can be overridden manually at any point.

A tank may have within its interior structures such as braces, pipes, valve operating rods and other obstructions that can block the jet stream of solvent from reaching and cleaning the entirety of the interior. In use of the cleaning apparatus of said U.S. Pat. No. 3,895,756, to clean behind such obstructions, the apparatus is tilted about its vertical axis. The spray nozzle assembly is carried at the end of a vertical pipe that extends through a top plate, and the top plate rests on the upper end of the tank manway. The assembly is tilted with respect to vertical by placing a wedge between the top plate and the manway to tilt the apparatus and thereby move the nozzle assembly sideways to clear the obstruction. The technique undesirably lifts the top plate off of the manway and opens the tank interior to the environment, which can result in toxic or corrosive substances and vapors being released to atmosphere and creating a hazardous environment for workers.

Depending upon the depth of the tank and the nature and amount of material to be cleaned from it, it usually is desirable to position the nozzle assembly at a height within the tank that enhances cleaning efficiency. It also is desirable that the height be such as to avoid interference with the solvent stream by obstructions within the tank. Prior tank cleaning apparatus does not readily accommodate convenient adjustment of the vertical height of the nozzle assembly.

OBJECTS OF THE INVENTION

An object of the present invention is to provide an apparatus for cleaning tanks, in which a support trunk, that carries at its lower end a spray nozzle assembly from which a jet stream of solvent is emitted, is pivotally supported in a top plate that closes an upper inlet opening to the tank, so that the support trunk can be pivoted with respect to vertical to shift the spray nozzle assembly from side to side to clean behind obstructions in the tank.

Another object is to provide such an apparatus in which the spray nozzle is driven to sweep back and forth along both longitudinal and transverse extents of the tank interior to direct a jet of solvent onto product residue to be cleaned from the tank.

Yet another object is to provide such an apparatus in which the spray nozzle can be rotationally adjusted about a vertical axis.

A further object is to provide such an apparatus in which the support trunk is vertically adjustable in the top plate to adjust the height of the spray nozzle within the tank.

Still another object is to provide such an apparatus that closes the inlet opening to the tank to prevent fugitive emissions of solvent or product to atmosphere and to protect an operator from liquid splashing out of the tank during cleaning.

A yet further object is to provide such an apparatus which utilizes adapter rings to mount the same apparatus on different sizes of tank inlets while closing the inlets.

A still further object is to provide such an apparatus in which both hydraulic control lines and a solvent delivery line for the nozzle assembly are contained within and extend through the support trunk.

SUMMARY OF THE INVENTION

The present invention provides apparatus for cleaning the interior of a vessel having an opening thereto. The apparatus comprises an elongate support trunk and a pressure jet means carried by the support trunk toward one end thereof. The pressure jet means includes nozzle means for emitting a jet stream of liquid, means for mounting the nozzle means for rotation in both directions about each of first and second axes, and power means for rotating the nozzle means about each axis. A plate means is toward an opposite end of the support trunk, the plate means has a passage therethrough and the support trunk extends through the passage, and means pivotally connect the support trunk to the plate means in the plate means passage. The plate means is adapted to be supported by the vessel across the opening to the vessel to extend the one end of the support trunk and the pressure jet means into the interior of the vessel, to clean the vessel interior with a jet stream of liquid emitted by the nozzle means. With the plate means supported by and across the opening to the vessel, the pivotal connecting means accommodates pivoting of the support trunk within the plate means passage to move the pressure jet means to selected positions within the vessel interior, without moving the plate means with respect to the vessel. The pivoting arrangement allows the pressure jet means to be positioned to direct a liquid spray behind any obstructions that may be in the vessel, while the plate means remains stationary on, across and closing the opening to the vessel.

The support trunk advantageously is tubular at least where it extends through the plate means passage, and conduit means for delivering liquid from a supply thereof to the nozzle means of the pressure jet means is contained within and extends through the plate means passage within the tubular part of the support trunk.

The support trunk extends vertically with the one end thereof downward when the plate means is supported by and across the opening to the vessel, and also advantageously included are means for adjusting the vertical position of the support trunk with respect to the plate means to adjust the vertical height of the pressure jet means in the vessel interior. The elongate support trunk is longitudinally movable with respect to the pivotal connecting means, and the vertical adjusting means comprises both the pivotal connecting means and damp means that are operable to inhibit or allow longitudinal movement of the support trunk with respect to the plate means. The clamp means is on the support trunk above the plate means and is adjustable along the support trunk to limit the maximum extent of downward vertical movement of the support trunk.

To accommodate mounting the cleaning apparatus on a vessel having an opening of given size, the plate means is circular and included is cylindrical adapter means having a lower end for being supported by the vessel around the opening thereto and an upper end for supporting the plate means. The elongate support trunk extends vertically through the adapter means with the one end thereof downward when the plate means is supported by the adapter means, to position the pressure jet means within the interior of the vessel, and the plate means is rotatably adjustable on the upper end of the adapter means to rotationally orient the support trunk, and thereby the pressure jet means, about a vertical axis of the support trunk. The first and second axes and the support trunk vertical axis are mutually orthogonal.

The foregoing and other objects, advantages and features of the invention will become apparent upon a consideration of the following detailed description, when taken in conjunction with the accompanying drawings.

DETAILED DESCRIPTION

The vessel cleaning apparatus of the invention efficiently removes interior deposits from highway trailers, rail tank cars and other vessels, using a jet spray cleaning technique. The apparatus is adapted to be supported on an inlet opening to a tank, such as on a manway, to extend a spray nozzle assembly into the interior of the tank, and when so supported doses the inlet to contain within the tank fumes and spray as may be generated as a jet stream of solvent is used to remove deposits from inside the tank. It is contemplated that up to about 250 gpm of wash solvent be sprayed at pressures up to about 250 psi to flush deposits out of a bottom drain of the tank. The system advantageously uses stainless piping, so that slurries with heavy solids concentrations and corrosive liquids can be sprayed in washing tank interiors. The spray nozzle directs a concentrated jet stream of solvent, which may be water, against deposits in the tank. So that the jet stream will engage all of the deposits, the spray nozzle is driven by hydraulic actuators that move the nozzle at controlled speeds back and forth across the length and width of the deposits, to blast the deposits into a flowing slurry for gravity discharge from the bottom drain. According to one advantageous feature of the invention, the spray nozzle is carried at the lower end of a support trunk that is mounted for pivoting about its vertical axis, so that it may be tilted with respect to vertical to move the spray nozzle sideways in order to direct the jet stream of solvent around and behind any obstructions in the tank interior. According to another advantageous feature, the vertical position of the support trunk is readily adjustable to position the spray nozzle within the tank at selected heights and to allow the entirety of the interior surfaces of the tank to be cleaned.

Figure 1:
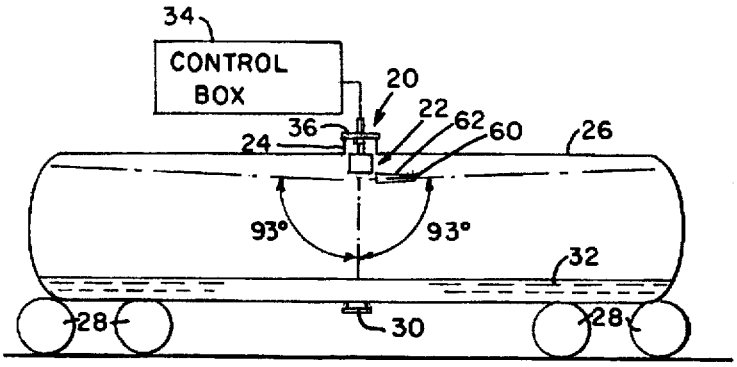
FIGS. 1 and 1*a* are outline side elevation views of a railway tank car with the cleaning apparatus of the present invention positioned to clean the interior of the tank.
Figure 2:
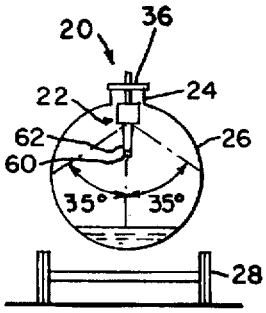
FIGS. 2 and 2*a* are outline end views of the railway tank car and the cleaning apparatus.
Figure 1A:
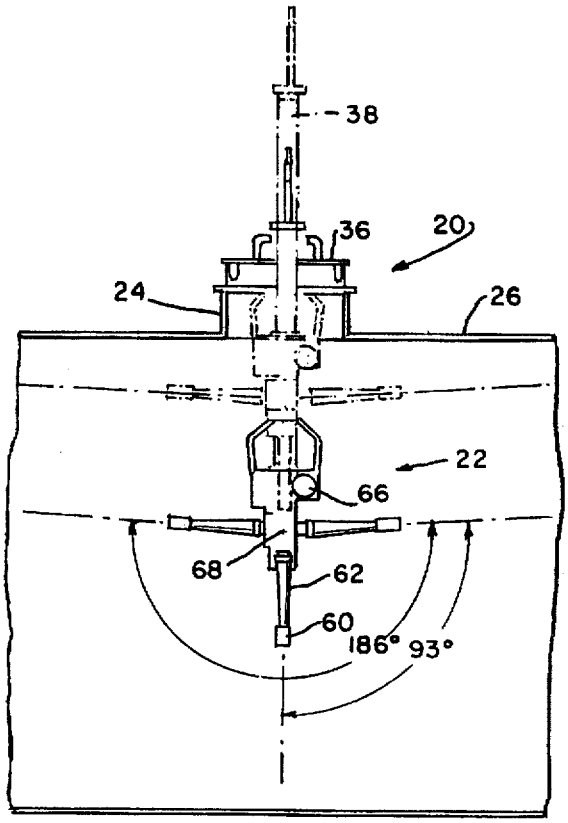
Figure 2A:
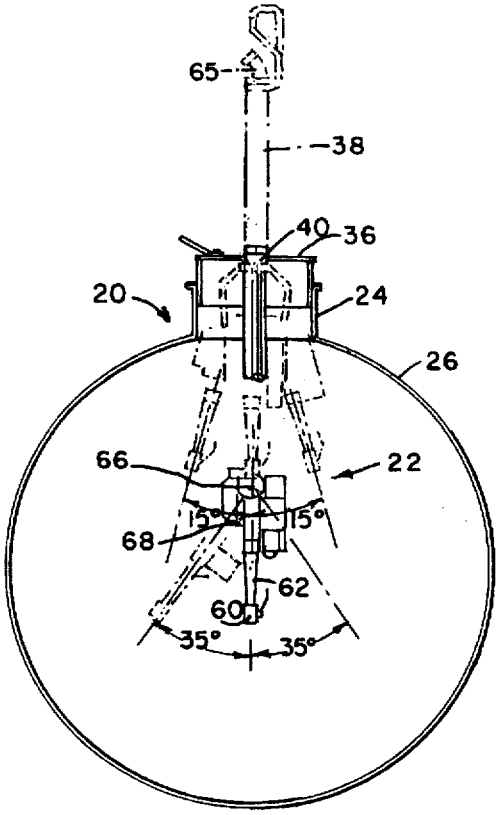

In FIGS. 1 and 2 the tank cleaning apparatus is indicated generally at 20 and includes a spray assembly, indicated generally at 22, adapted to be lowered through a top inlet opening, hatch or manway 24 of an enclosed vessel 26. The illustrated vessel is a tank of a rail tank car that includes wheel assemblies 28 for travel on rails. In its usual form, the tank has a bottom drain opening 30 to facilitate emptying and cleaning of the tank.

The spray assembly 22 has a spray nozzle that is rotatable back and forth about longitudinal and transverse axes, so that a jet stream of solvent emitted from the nozzle sweeps the tank interior in both longitudinal and transverse directions to clean sludge or other debris 32 from the interior of the tank. A control box 34 controls the back and forth rotational movement of the spray nozzle about each of its longitudinal and transverse axes. The control box may be of any suitable type, such for example of a type as described in aforementioned U.S. Pat. No. 3,895,756, the entirety of the teachings of which are specifically incorporated herein by reference.

Figure 6:
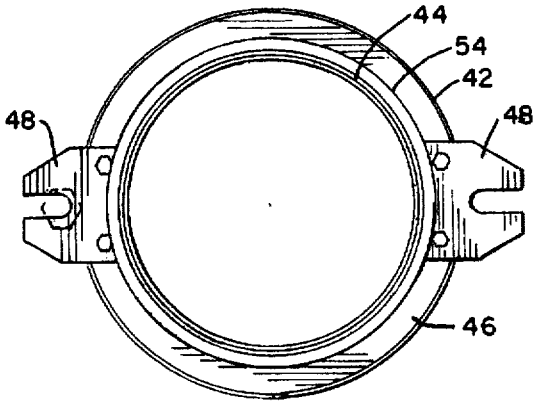
FIG. 6 is a top plan view of an adapter ring for mounting the cleaning apparatus on a manway of the tank.
Figure 7:
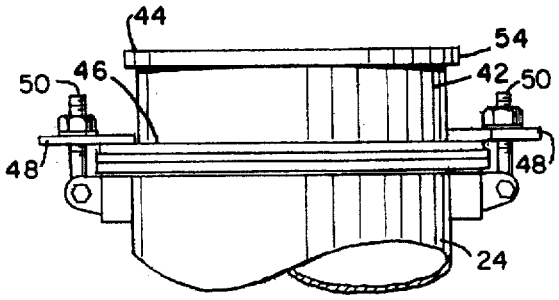
FIG. 7 is a side elevation view showing the adapter ring of FIG. 6 connected to the manway.
Figure 8:
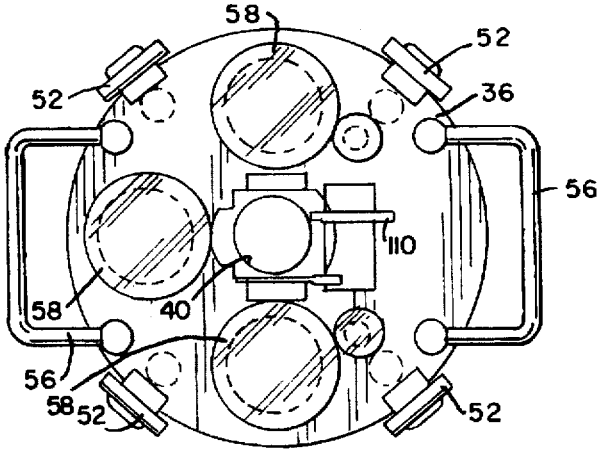
FIG. 8 is a top plan view of the top plate.

The cleaning apparatus 20 includes a cover or top plate 36 carrying a generally vertically extending coaxial support trunk 38 that passes through a sealed ball joint 40 which is pivotally connected to the top plate for pivotal tilting movement of the support trunk about its longitudinal (vertical) axis and with respect to the top plate. The top plate is adapted to be supported on the manway 24 of the tank 26. In order that a top plate of given size or diameter may be supported on tank car hatches of various different diameters, a plurality of hatch adapter rings 42 are provided, one of which is shown in FIGS. 6 and 7. Each hatch adapter ring is generally cylindrical and has an upper end 44 of a diameter about the same as that of the top plate, and a lower flanged end 46 that is made to have a diameter about the same as the diameter of the upper end of a tank car hatch on which the hatch adapter ring is to mount to the top plate. The hatch adapter ring has a pair of diametrically opposed holddown plates 48 that allow the lower end of the adapter ring to be supported on and attached to the upper end of the tank car hatch in the manner as would be a cover that normally closes the hatch, i.e., by means of swing bolts 50. The hatch adapter ring supports the top plate 36 on its upper end 44, with four orthogonally spaced top plate clamps 52 (FIG. 8) gripping the underside of a circumferential lip 54 of the adapter ring to securely mount the top plate on the adapter ring and close the inlet opening to the tank. The top plate has handles 56 to facilitate guiding the cleaning apparatus to the proper location, and three accessory ports 58 to accommodate access to and viewing of the tank interior without removal of the top plate, for example to enable an operator to visually see inside the tank and to accommodate withdrawal of vapor from the tank interior.

The cleaning apparatus 20 utilizes a single stream high pressure spray head or valve nozzle 60 mounted on a movable nozzle assembly 62 to produce a concentrated high pressure jet stream of solvent at a flow rate of up to about 250 gpm and at a pressure of up to about 250 psi. The valve nozzle is manually opened to spray and can be closed when spraying is complete and the spray assembly 22 is withdrawn from the tank to prevent dripping of solvent, which can be water. Solvent is delivered to the spray head by a relatively large diameter center pipe 64 that extends generally coaxially within and through the tubular support trunk 38, passes with the support trunk through the ball joint 40 in the top plate 36, and connects to a high pressure source of cleaning liquid or solvent through an inlet fitting 65.

Figure 3:
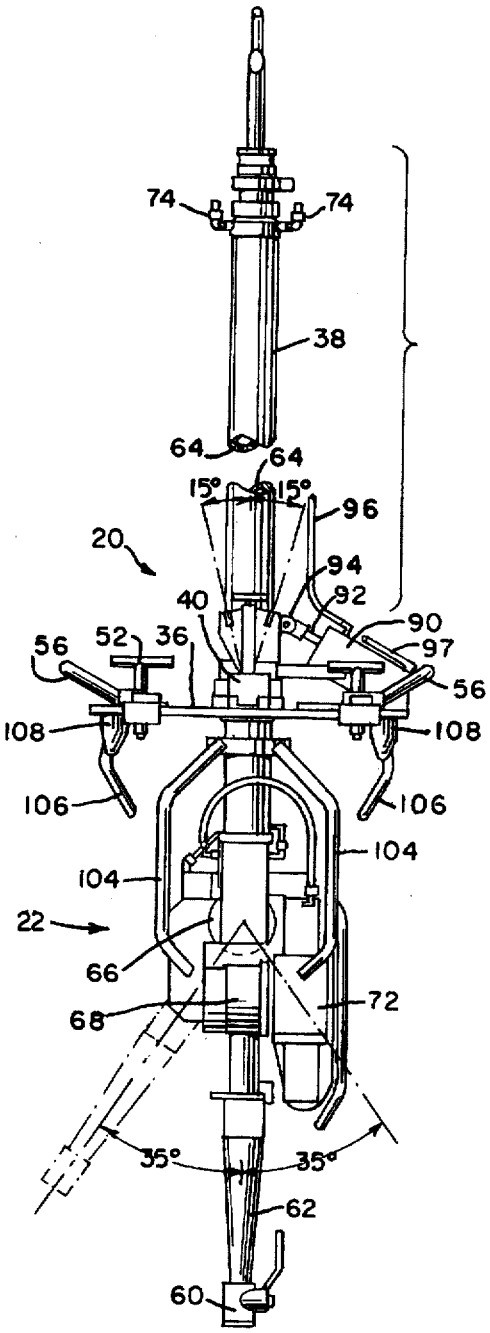
FIG. 3 is a side elevation view of the cleaning apparatus, taken perpendicular to a longitudinal axis about which a spray nozzle of the apparatus is rotatable back and forth in transverse directions.
Figure 4:
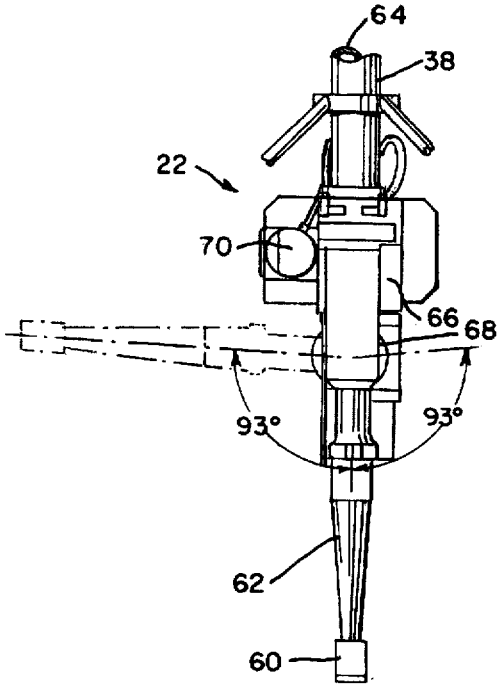
FIG. 4 is a side elevation view of the spray nozzle, taken perpendicular to a transverse axis about which the spray nozzle is rotatable back and forth in longitudinal directions.

As best shown in FIGS. 3 and 4, the spray assembly 22 includes means to rotate or swing the nozzle assembly 62 and its spray head 60 about a first generally horizontal axis and a second generally horizontal axis perpendicular to the first. This is accomplished by leading the solvent flow path through the center pipe 64 out of the coaxial support trunk 38 and through a first liquid tight swivel joint 66 located on the first axis and then downward through a second liquid tight swivel joint 68 located on the second axis, the second swivel joint being connected to and supporting the nozzle assembly 62. The first axis can be oriented to extend generally longitudinally along the tank 26 (FIGS. 2 and 3), so that rotation of the nozzle assembly 62 about the first axis moves the spray head and the jet steam emitted from the spray head back and forth transversely of the tank. The second axis would then extend generally transversely of the tank (FIGS. 1 and 4), so that rotation of the nozzle assembly about the second axis moves the spray head and the jet stream of solvent emitted from the spray head back and forth longitudinally of the tank. The two swivel joints 66 and 68 thereby enable the nozzle assembly and its spray head 60 to be rotatably moved in a manner to direct a jet stream of solvent back and forth both transversely and longitudinally of the tank interior. It is contemplated that the nozzle assembly can be, for example, rotatable about the first axis back and forth transversely of the tank through an are of about 70°, i.e., about 35° to each side of vertical, and about the second axis back and forth longitudinally of the tank through an are of about 186°, i.e., about 93° to each side of vertical, for the normal cleaning of the tank bottom. However, larger or smaller angles of rotation transversely and longitudinally are contemplated and can be accommodated.

Two-way rotary hydraulic actuators 70 and 72 are operatively connected to the respective liquid tight swivel joints 66 and 68 and are operatively controlled by the control box 34 to rotate the swivel joints back and forth in both directions about their respective axes. The actuators may be substantially identical and conventional in construction, each comprising, for example, a double acting hydraulic cylinder containing a linear moving piston that can mount a rod or rack for actuating a pinion of an axially rotatable shaft of a respective swivel joint, such as in said U.S. Pat. No. 3,895,756, whereby the actuators move the nozzle assembly 62 in both directions about each axis. Flow of hydraulic fluid into one end of an actuator cylinder causes rotation of its associated swivel in one direction, and flow into the other end causes rotation of the swivel in the opposite direction. To avoid a potential for fire or explosion due to electrical sparking, compressed air advantageously is used as a power source, and is converted to hydraulic pressure to drive the nozzle assembly in a controlled sweeping pattern across the length and width of the tank 26. The hydraulic fluid is introduced to fittings 74 at the upper end of the support trunk 38, two of four such fittings being shown in FIG. 3. From the fittings, the hydraulic fluid flows through respective hydraulic fluid lines that extend through the tubular support trunk and around the center pipe 64 within the support trunk, down to respective ones of the rotary hydraulic actuators. The speed and direction of nozzle movement is regulated by the setting of controls of the control box 34, for example by a hydraulic master/slave circuit that allows independent adjustment of arc travel and speed on each axis, as taught in said U.S. Pat. No. 3,895,756. The arrangement advantageously is such as to progressively slow movement of the nozzle in the longitudinal direction in the tank as the nozzle moves away from its generally vertical position where it is pointing down. This slowing action gives solvent projected from the nozzle more working time as it progresses to the ends of the tank.

Figure 5:
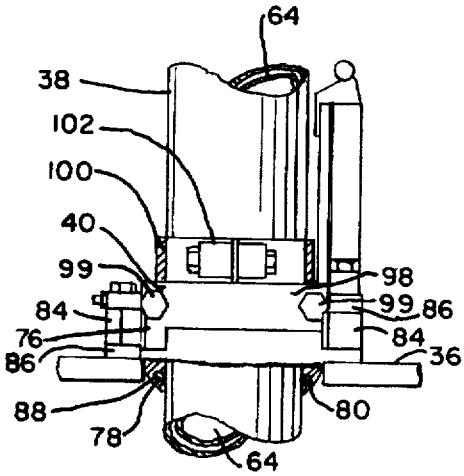
FIG. 5 shows a portion of a support trunk of the apparatus, which carries at its lower end the spray nozzle assembly, pivotally connected to a top plate of the apparatus.

The spray assembly 22 and its nozzle assembly 62 also are movable in transverse directions by tilting the support trunk 38 with respect to vertical. The support trunk extends through the sealed ball joint 40 that is pivotally connected to the top plate 36. As seen in FIG. 5, the ball joint 40 includes a clamp assembly 76 and a ball 78 through which the support trunk extends, and an O-ring seal 80 between the ball and the support trunk. The clamp assembly has a trunnion in the form of a pair of diametrically opposed outwardly extending pins 84 that are rotatably received in an annular bearing block 86. The annular bearing block is supported on the upper surface of the top plate around a passage or opening 88 in the top plate, within which opening the ball 78 is received. The arrangement is such that with the top plate supported on the tank 26 with the handles 56 extending toward the sides of the tank, the pins 84 extend generally along the longitudinal extent of the tank. Tilting or pivoting of the support trunk 38 within the ball joint 40, about the pins 84 and with respect to the top plate, therefore moves the lower end of the support trunk and the spray assembly 22 from side to side transversely within the tank. The support trunk can be pivoted about 15° to each side of vertical, i.e., through a total arcuate extent of about 30°, although larger or smaller angles of tilt can be accommodated. The arrangement allows the spray assembly to be selectively moved from side to side within the tank to be positioned to one side or the other of an obstruction in the tank, so that the jet stream of solvent emitted from the nozzle assembly can be directed around and behind the obstruction to clean the tank interior behind the obstruction.

The support trunk can be manually pivoted. Alternatively, means can be provided to automatically pivot the support trunk to a desired inclination, one such means being shown in FIG. 3 as a double acting cylinder 90 having a piston rod 92 connected to a retainer assembly 94 that is coupled to the support trunk. Actuation of the cylinder tilts the support trunk, and control lines 96 and 97 connect to the cylinder on opposite sides of the piston to operate the same.

In addition to the support trunk 38 being pivotable in the top plate 36 to locate the spray assembly 22 at selected transverse positions within the tank 26, the support trunk also is vertically adjustable in the top plate to locate the spray assembly at selected vertical heights in the tank to improve the cutting action of the jet spray on product residue being cleaned from the tank and to enable the entirety of the tank interior to be cleaned. Vertical adjustment of the support trunk is accommodated both by a split ring part 98 of the ball joint clamp assembly 76, which can be tightened around the support trunk 38 by means of a pair of cap screws 99, and by a clamp assembly 100 around the support trunk above the ball joint 40, the clamp assembly having means 102 accommodating loosening and sliding movement of the clamp assembly along the support trunk, and tightening of the clamp assembly to the support trunk. The clamp assembly normally rests on the ball joint clamp assembly 76.

The split ring 98 and clamp assembly 100 locate the support trunk 38 vertically with respect to the top plate 36 and determine the vertical position or height of the lower end of the support trunk and of the spray assembly 22 in the tank. The arrangement is such that the split ring 98 is the primary vertical positioning clamp and the clamp assembly 100 is a backup clamp. To lower the support trunk, the clamp assembly 100 is loosened from around the support trunk, moved upwardly above the clamp assembly 76 by the amount the support trunk is to be lowered, and then retightened around the support trunk. The split ring 98 is then loosened to allow the support trunk to be moved downwardly until the clamp assembly 100 rests on the clamp assembly 76, whereupon the split ring is retightened around the support trunk. To raise the support trunk, the split ring 98 is loosened, the support trunk is then raised by a selected mount, and the split ring is then retightened, following which the clamp assembly 100 is loosened, lowered to rest on the clamp assembly 76, and then retightened.

Operation of the cleaning apparatus 20 will be described in connection with cleaning the tank 26. As shown in FIGS. 1 and 2, the tank can have a layer of sediment or sludge 32 in its bottom, but otherwise be empty. By knowing the internal dimensions of the tank and the approximate depth of the sediment, it is possible to determine the most advantageous height of the spray assembly 22 within the tank, as well as the maximum are of sweep of the spray nozzle 62, in order to most efficiently blast with a solvent jet the entirety of the sediment out to its perimeter. Because of the swivel joints 66 and 68 and their respective rotary actuators 70 and 72, it is possible to pivot the spray nozzle 62 around each of its longitudinal and transverse axes either simultaneously or separately, depending upon the setting or programming of the control box 34.

To ready the cleaning apparatus 20 for operation, the tank drain 30 is opened and a hatch adapter ring 42 of appropriate size is mounted on the tank hatch or manway 24. The cleaning apparatus is then lowered by a hoist into and through the hatch adapter ring and hatch until the top plate 36 rests on the top 44 of the adapter ring. During lowering of the cleaning apparatus, guard bars 104 guide and protect the spray assembly 22 as it passes through the adapter ring and hatch, and guard bars 106 guide the top plate 36 into and prevent it from banging against the hatch adapter ring. Pins 108 extend downwardly from the top plate and enter the adapter ring to accurately locate the top plate to be generally coaxial with the adapter ring. As the cleaning apparatus is lowered into and through the adapter ring and hatch, it is manually guided so that the top plate handles 56 are toward opposite sides of the tank, which orients the spray assembly 22 within the tank with the axis of rotation of the swivel joint 66 extending generally longitudinally of the tank and the axis of rotation of the swivel joint 68 extending generally transversely of the tank. The top plate clamps 52 are then used to grip the lip 54 of and secure the top plate to the adapter ring. Since the support trunk 38 extends through and is sealed with the ball joint 40, and the solvent supply and hydraulic fines extend through the support trunk, the cleaning apparatus closes the inlet to the tank.

With the cleaning apparatus 20 mounted on the tank, the control box 34 is operated to aim the spray head 60 at the drain 30 and solvent is delivered to the spray head to cut sludge and sediment away from and clear the drain. Once the tank drain is open and running free, the actuator 72 is operated to sweep the nozzle assembly 62 and its spray head 60 back and forth in the longitudinal direction down the center of the tank from one end to the other until a trench is cut through the sludge to carry fluid to the drain. General cleaning of the tank interior then begins.

The spray assembly 22 operates from a fixed location(s) and directs a liquid jet at the substantially rectangular bed of sediment 32 at the bottom of the tank 26 along a path and at a speed determined by the control box 34. The fixed location is determined both by the vertical position selected for the spray assembly and by the degree of any tilt given to the support trunk 38 in order to clean behind any obstructions in the tank, although the nature and position of obstructions within the tank may require that the fixed location be changed from time to time during a cleaning operation to accommodate thorough cleaning of the tank interior. In cleaning the bed of sediment from the tank bottom, the nozzle assembly 62 is moved by the hydraulic actuators 70 and 72 along the longitudinal and transverse directions at controlled speeds. In the case of longitudinal movement of the nozzle assembly, the high pressure jet of solvent must travel a progressively greater distance from the spray head 60 as the angle of rotation is increased and the spray is directed toward and at the longitudinal ends of the tank, which allows the spray to diverge more and lose some of its speed and effectiveness. Also, for a constant rate of rotation, the spray spends progressively less time impinging a given area of sediment as it moves toward the ends of the tank. The control box therefore operates the actuator 72, which moves the nozzle assembly longitudinally of the tank, in a manner to progressively increase the dwell time of the spray toward the end of each longitudinal reciprocal movement of the nozzle assembly, which provides more spray time near the ends of the tank.

As the tank 26 starts to clear, the operator can observe the tank interior through the accessory ports 58 in the top plate 36 and manually override the control box automatic controls, if and as necessary, to spot clean selected areas by pointing the nozzle at them.

After the longitudinal trench is formed in the sludge along the center of the bottom of the tank, the transverse and longitudinal nozzle movement controls of the control box 34 are usually automatically implemented. The transverse speed of the nozzle assembly 62 is normally set at a very slow rate, whereas the longitudinal speed is set at relatively rapid rate. In this manner, the solvent jet is directed at successive longitudinal sectors of the sediment bed toward the previously formed trench, which causes the sediment to be broken up and washed down into the trench and out of the bottom drain 30.

When cleaning of the tank is completed, the solvent flow is turned off and the nozzle assembly 62 and its spray head 60 are pointed straight down. The top plate 36 is then unclamped from the adapter ring 44 and the cleaning apparatus is hoisted out of the tank while being guided by the handles 56 on the top plate. When the nozzle assembly is elevated sufficiently that the spray head can be reached, its valve may be closed to prevent solvent from dripping from the nozzle assembly.

The tank cleaning apparatus of the present invention provides numerous advantages not obtainable from prior devices. Because the support trunk 38 is pivotable in the top plate 36, during cleaning the top plate can remain flat on the adapter ring 42 and continuously close the tank inlet to control fugitive emissions of solvent or product from the tank and protect an operator from being splashed by liquid from inside the tank. Since a plurality of adapter rings of different sizes are used to accommodate mounting of the cleaning apparatus on tanks having various different hatch sizes, the same top plate 36 can be used with the apparatus while retaining the capability of sealing the apparatus to different tanks. Because the hydraulic control lines and solvent delivery tube are integrated coaxially into the tubular support trunk, they are protected against physical contact and damage and facilitate maintaining the inlet to the tank closed during cleaning. The support trunk is readily vertically adjustable by means of the ball joint split ring 98 and the collar 100 to adjust the vertical position of the spray assembly 22 within the tank to obtain a more effective cutting action of the solvent jet on product residue. Also, the pivoting ball joint allows either manual or automatic control of a vertical tilt axis of the support trunk, so that the entire spray assembly can easily be shifted from side to side within a tank to clean behind any braces, pipes, valve operating rods or other obstructions as may be in the tank. Further, with the split ring 98 loosened, a handle 110 of the clamp assembly 100 can be used to rotate the support trunk about its vertical or longitudinal axis with respect to the top plate, if and as desired to selectively rotationally orient the longitudinal and transverse axes of the spray assembly relative to the longitudinal and transverse dimensions of the tank. Additionally, because of the ability to adjust the vertical height of the spray assembly and to rotationally orient the spray assembly about the vertical axis of the support trunk, the spray assembly can be selectively vertically positioned and rotationally oriented in a manner to enable all interior surfaces of the tank to be cleaned, and not just the bottom surfaces.

While one embodiment of the invention has been described in detail, various modifications and other embodiments thereof may be devised by one skilled in the art without departing from spirit and scope of the invention, as defined in the appended claims.

What is claimed is:

1. Cleaning apparatus for vessels having an opening thereto, said cleaning apparatus comprising an elongate support trunk; pressure jet means carried by said support trunk toward one end thereof, said pressure jet means including nozzle means for emitting a jet stream of liquid, means for mounting said nozzle means for rotation in both directions about each of first and second different axes, and hydraulically operated power means for rotating said nozzle means about each said axis; plate means toward an opposite end of said support trunk, said plate means having a passage therethrough and said support trunk extending through said passage; means for pivotally connecting said support trunk to said plate means, said plate means supportable by the vessel across the opening to the vessel to extend said one end of said support trunk and said pressure jet means into an interior of the vessel to clean the vessel interior with a jet stream of liquid emitted by said nozzle means, said pivotal connecting means accommodating pivoting of said support trunk with respect to said plate means, while said plate means is supported by the vessel, to move said pressure jet means to selected positions within the vessel interior without moving said plate means with respect to the vessel; and conduit means for connection to each of a supply of liquid and a supply of hydraulic fluid to the exterior of the vessel and extending from the supplies to, within and through an interior of said support trunk from a side of said plate means to the exterior of the vessel to said pressure jet means for delivering liquid to said nozzle means and hydraulic fluid to said hydraulically operated power means, whereby said support trunk protects said conduit means within it from physical contact and damage.

2. Cleaning apparatus as in claim 1, wherein said pivotal connecting means and said support trunk close said passage through said plate means and said plate means, when on the vessel and across the opening in the vessel closes the opening, whereby said support trunk can be pivoted while said plate means continues to close the opening in the vessel.

3. Cleaning apparatus as in claim 1, wherein said support trunk has a longitudinal axis and extends generally vertically with said one end thereof downward when said plate means is across the opening to the vessel, and including means for longitudinally adjusting the position of said support trunk with respect to said plate means to adjust the vertical height of said pressure jet means in the vessel interior.

4. Cleaning apparatus as in claim 3, wherein said pivotal connecting means includes said longitudinally adjusting means and said longitudinally adjusting means is operable to selectively enable or inhibit longitudinal movement of said support trunk with respect to said pivotal connecting means.

5. Cleaning apparatus as in claim 4, including clamp means on said support trunk above said pivotal connecting means, said clamp means being adjustable along said support trunk to limit the extent of downward movement of said support trunk with respect to said pivotal connecting means.

6. Cleaning apparatus as in claim 1, wherein said elongate support trunk has a longitudinal axis and including means for rotating said support trunk about its longitudinal axis and with respect to said plate means to thereby rotationally adjust said pressure jet means within the vessel.

7. Cleaning apparatus as in claim 6, wherein said first and second axes and said support trunk longitudinal axis are mutually orthogonal.

8. Cleaning apparatus for vessels having an opening thereto, said cleaning apparatus comprising an elongate support trunk; pressure jet means carried by said support trunk toward one end thereof, said pressure jet means including nozzle means for emitting a jet stream of liquid, means for mounting said nozzle means for rotation in both directions about each of first and second different axes, and power means for rotating said nozzle means about each said axis; plate means toward an opposite end of said support trunk, said plate means having a passage therethrough and said support trunk extending through said passage; and means for connecting said support trunk to said plate means, said plate means being supportable by the vessel across the opening to the vessel, with said support trunk extending generally vertically, to extend said one end of said support trunk and said pressure jet means downward into an interior of the vessel to clean the vessel interior with a jet stream of liquid emitted by said nozzle means, said means for connecting said support trunk to said plate means including means for vertically adjusting the position of said support trunk with respect to said plate means to adjust the vertical height of said pressure jet means in the vessel interior, said vertically adjusting means including clamp means on said elongate support trunk to the side of said plate means to the exterior of the vessel said plate means passage being of a size to prevent passage of said clamp means therethrough and said clamp means being adjustably positionable along said support trunk and for resting on said plate means to control the amount by which said support trunk extends downwardly through and below said plate means.

9. Cleaning apparatus as in claim 8, wherein said vertically adjusting means of said connecting means includes clamp means that is adjustable to control the amount by which said support trunk extends downwardly through and below said plate means passage.

10. Cleaning apparatus as in claim 8, wherein said means for connecting said support trunk to said plate means pivotally connects said support trunk to said plate means, so that said support trunk is pivotable with respect to said plate means to move said pressure jet means to selected positions within said vessel interior without moving said plate means with respect to the vessel.

11. Cleaning apparatus as in claim 10, wherein said means for connecting said support trunk to said plate means closes said plate means passage.

12. Cleaning apparatus as in claim 8, wherein said first and second axes and said support trunk longitudinal axis are mutually perpendicular.

13. Cleaning apparatus as in claim 8, wherein said power means comprises hydraulically operated power means, and including conduit means for connection to each of a supply of liquid and a supply of hydraulic fluid to the exterior of the vessel and extending from the supplies to, within and through the interior of said support trunk from a side of said plate means to the exterior of the vessel to said pressure jet means for delivering liquid to said nozzle means and hydraulic fluid to said hydraulically operated power means.

14. Cleaning apparatus as in claim 8, including valve means at an outlet from said nozzle means, said valve means being operable between a first state opening said nozzle means for emitting a jet stream of liquid therefrom and a second state closing said nozzle means to prevent emission of liquid therefrom.

15. Cleaning apparatus as in claim 8, including an adapter for supporting said plate means on the vessel across the opening thereto, said adapter having an upper end for supporting said plate means thereon, a lower end for being supported on the vessel around the opening thereto, and a body between said upper and lower ends.

16. Cleaning apparatus for vessels having an-opening thereto, said cleaning apparatus comprising an elongate support trunk; pressure jet means carried by said support trunk toward one end thereof, said pressure jet means including nozzle means for emitting a jet stream of liquid, means for mounting said nozzle means for rotation in both directions about each of first and second different axes, and power means for rotating said nozzle means about each said axis; plate means toward an opposite end of said support trunk, said plate means having a passage therethrough and said support trunk extending through said passage; means for pivotally connecting said support trunk to said plate means, said plate means being supportable across the opening to the vessel to extend said one end of said support trunk and said pressure jet means into an interior of the vessel to clean the vessel interior with a jet stream of liquid emitted by said nozzle means, said pivotal connecting means accommodating pivoting of said support trunk with respect to said plate means, while said plate means is supported by the vessel, to move said pressure jet means to selected positions within the vessel interior without moving said plate means with respect to the vessel; and valve means at an outlet from said nozzle means, said valve means being operable between a first state opening said nozzle means for emitting a jet stream of liquid therefrom and a second state closing said nozzle means to prevent emission of liquid therefrom.

17. Cleaning apparatus for vessels having an opening thereto, said cleaning apparatus comprising an elongate support trunk; pressure jet means carried by said support trunk toward one end thereof, said pressure jet means including nozzle means for emitting a jet stream of liquid, means for mounting said nozzle means for rotation in both directions about each of first and second different axes, and power means for rotating said nozzle means about each said axis; plate means toward an opposite end of said support trunk, said plate means having a passage therethrough and said support trunk extending through said passage; means for pivotally connecting said support trunk to said plate means, said plate means being supportable across the opening to the vessel to extend said one end of said support trunk and said pressure jet means into an interior of the vessel to clean the vessel interior with a jet stream of liquid emitted by said nozzle means, said pivotal connecting means accommodating pivoting of said support trunk with respect to said plate means, while said plate means is supported by the vessel, to move said pressure jet means to selected positions within the vessel interior without moving said plate means with respect to the vessel; and an adapter for supporting said plate means on the vessel across the opening thereto, said adapter having an upper end for supporting said plate means thereon, a lower end for being supported on the vessel around the opening thereto, and a body between said upper and lower ends.

18. Cleaning apparatus for vessels having an opening thereto, said cleaning apparatus comprising an elongate support trunk; pressure jet means carried by said support trunk toward one end thereof, said pressure jet means including nozzle means for emitting a jet stream of liquid, means for mounting said nozzle means for rotation in both directions about each of first and second different axes, and power means for rotating said nozzle means about each said axis; plate means toward an opposite end of said support trunk, said plate means having a passage therethrough and said support trunk extending through said passage; means for pivotally connecting said support trunk to said plate means, said plate means being supportable across the opening to the vessel to extend said one end of said support trunk and said pressure jet means into an interior of the vessel to clean the vessel interior with a jet stream of liquid emitted by said nozzle means, said pivotal connecting means accommodating pivoting of said support trunk with respect to said plate means, while said plate means is supported by the vessel, to move said pressure jet means to selected positions within the vessel interior without moving said plate means with respect to the vessel, wherein said plate means has at least one normally closed accessory port that can be opened to accommodate access to and viewing of the vessel interior when said plate means is across the opening to the vessel.

19. Cleaning apparatus as in claim 18, wherein said power means comprises hydraulically operated power means, and including conduit means for connection to each of a supply of liquid and a supply of hydraulic fluid to the exterior of the vessel and extending from the supplies to, within and through the interior of said support trunk from a side of said plate means to the exterior of the vessel to said pressure jet means for delivering liquid to said nozzle means and hydraulic fluid to said hydraulically operated power means.

20. Cleaning apparatus as in claim 18, including valve means at an outlet from said nozzle means, said valve means being operable between a first state opening said nozzle means for emitting a jet stream of liquid therefrom and a second state closing said nozzle means to prevent emission of liquid therefrom.

21. Cleaning apparatus as in claim 18, including an adapter for supporting said plate means on the vessel across the opening thereto, said adapter having an upper end for supporting said plate means thereon, a lower end for being supported on the vessel around the opening thereto, and a body between said upper and lower ends.

22. Cleaning apparatus for vessels having an opening thereto, said cleaning apparatus comprising an elongate support trunk; pressure jet means carried by said support trunk toward one end thereof, said pressure jet means including nozzle means for emitting a jet stream of liquid, means for mounting said nozzle means for rotation in both directions about each of first and second different axes, and power means for rotating said nozzle means about each said axis; plate means toward an opposite end of said support trunk, said plate means having a passage therethrough and said support trunk extending through said passage; means for connecting said support trunk to said plate means, said plate means being supportable by the vessel across the opening to the vessel, with said support trunk extending generally vertically, to extend said one end of said support trunk and said pressure jet means downward into an interior of the vessel to clean the vessel interior with a jet stream of liquid emitted by said nozzle means, said means for connecting said support trunk to said plate means including means for longitudinally adjusting the position of said support trunk with respect to said plate means to adjust the vertical height of said pressure jet means in the vessel interior; and valve means at an outlet from said nozzle means, said valve means being operable between a first state opening said nozzle means for emitting a jet stream of liquid therefrom and a second state closing said nozzle means to prevent emission of liquid therefrom.

23. Cleaning apparatus for vessels having an opening thereto, said cleaning apparatus comprising an elongate support trunk; pressure jet means carried by said support trunk toward one end thereof, said pressure jet means including nozzle means for emitting a jet stream of liquid, means for mounting said nozzle means for rotation in both directions about each of first and second different axes, and power means for rotating said nozzle means about each said axis; plate means toward an opposite end of said support trunk, said plate means having a passage therethrough and said support trunk extending through said passage; means for connecting said support trunk to said plate means, said plate means being supportable by the vessel across the opening to the vessel, with said support trunk extending generally vertically, to extend said one end of said support trunk and said pressure jet means downward into an interior of the vessel to clean the vessel interior with a jet stream of liquid emitted by said nozzle means, said means for connecting said support trunk to said plate means including means for vertically adjusting the position of said support trunk with respect to said plate means to adjust the vertical height of said pressure jet means in the vessel interior; and an adapter for supporting said plate means on the vessel across the opening thereto, said adapter having an upper end for supporting said plate means thereon, a lower end for being supported on the vessel around the opening thereto, and a body between said upper and lower ends.

24. Cleaning apparatus for vessels having an opening thereto, said cleaning apparatus comprising an elongate support trunk; pressure jet means carried by said support trunk toward one end thereof, said pressure jet means including nozzle means for emitting a jet stream of liquid, means for mounting said nozzle means for rotation in both directions about each of first and second different axes, and power means for rotating said nozzle means about each said axis; plate means toward an opposite end of said support trunk, said plate means having a passage therethrough and said support trunk extending through said passage; means for connecting said support trunk to said plate means, said plate means being supportable by the vessel across the opening to the vessel, with said support trunk extending generally vertically, to extend said one end of said support trunk and said pressure jet means downward into an interior of the vessel to clean the vessel interior with a jet stream of liquid emitted by said nozzle means, said means for connecting said support trunk to said plate means including means for vertically adjusting the position of said support trunk with respect to said plate means to adjust the vertical height of said pressure jet means in the vessel interior, wherein said plate means has at least one accessory port that can be opened to accommodate access to and viewing of the vessel interior when said plate means is across the opening to the vessel.

25. Cleaning apparatus as in claim 24, wherein said power means comprises hydraulically operated power means, and including conduit means for connection to each of a supply of liquid and a supply of hydraulic fluid to the exterior of the vessel and extending from the supplies to, within and through the interior of said support trunk from a side of said plate means to the exterior of the vessel to said pressure jet means for delivering liquid to said nozzle means and hydraulic fluid to said hydraulically operated power means.

26. Cleaning apparatus as in claim 24, including valve means at an outlet from said nozzle means, said valve means being operable between a first state opening said nozzle means for emitting a jet stream of liquid therefrom and a second state closing said nozzle means to prevent emission of liquid therefrom.

27. Cleaning apparatus as in claim 24, including an adapter for supporting said plate means on the vessel across the opening thereto, said adapter having an upper end for supporting said plate means thereon, a lower end for being supported on the vessel around the opening thereto, and a body between said upper and lower ends.

* * * * *